US008196332B2

(12) United States Patent
Brentzel

(10) Patent No.: US 8,196,332 B2
(45) Date of Patent: Jun. 12, 2012

(54) FORWARD SCOUT SCOPE MOUNT FOR FIREARM

(75) Inventor: Joseph D. Brentzel, Trafford, PA (US)

(73) Assignee: Brenshok, LLC, Russellton, PA (US)

( * ) Notice: Subject to any disclaimer, the term of this patent is extended or adjusted under 35 U.S.C. 154(b) by 201 days.

(21) Appl. No.: 12/772,635

(22) Filed: May 3, 2010

(65) Prior Publication Data

US 2010/0275497 A1 Nov. 4, 2010

Related U.S. Application Data

(60) Provisional application No. 61/215,357, filed on May 4, 2009.

(51) Int. Cl.
*F41G 1/387* (2006.01)

(52) U.S. Cl. ..... 42/125; 42/124

(58) Field of Classification Search ..... 42/123–130, 42/90

See application file for complete search history.

(56) References Cited

U.S. PATENT DOCUMENTS

| | | | | |
|---|---|---|---|---|
| 3,979,848 | A | 9/1976 | Ackerman, Jr. | |
| 4,027,414 | A | 6/1977 | Felix | |
| 4,090,780 | A | 5/1978 | Davis | |
| 4,114,302 | A | 9/1978 | Litman | |
| 4,367,606 | A | 1/1983 | Bechtel | |
| 4,835,895 | A | 6/1989 | Bowen | |
| 4,905,396 | A * | 3/1990 | Bechtel | 42/127 |
| 5,107,612 | A * | 4/1992 | Bechtel | 42/115 |
| 5,343,650 | A * | 9/1994 | Swan | 42/117 |
| D364,668 | S | 11/1995 | Keng | |
| 5,522,166 | A | 6/1996 | Martel | |
| 5,771,595 | A | 6/1998 | Bell | |
| 5,806,228 | A | 9/1998 | Martel et al. | |
| 6,226,880 | B1 | 5/2001 | Pitre | |
| 6,336,285 | B1 * | 1/2002 | Baumer | 42/124 |
| 6,381,895 | B1 * | 5/2002 | Keeney et al. | 42/124 |
| D477,650 | S | 7/2003 | Rubin et al. | |
| 6,594,938 | B2 | 7/2003 | Horton | |
| 6,640,481 | B1 | 11/2003 | Williams, Jr. | |
| 6,701,660 | B2 | 3/2004 | Stover | |
| 6,886,288 | B1 | 5/2005 | Yocum et al. | |
| 6,931,779 | B1 | 8/2005 | Galuppo, Jr. | |
| 7,062,876 | B2 | 6/2006 | Wilson | |
| 7,140,143 | B1 | 11/2006 | Ivey | |
| 7,765,731 | B1 * | 8/2010 | Liebig | 42/127 |
| 7,814,699 | B2 * | 10/2010 | Storch et al. | 42/137 |
| 7,908,782 | B1 * | 3/2011 | LaRue | 42/128 |
| 2002/0089742 | A1 | 7/2002 | Otteman | |
| 2004/0144013 | A1 | 7/2004 | Leatherwood | |
| 2005/0241212 | A1 * | 11/2005 | Swan | 42/127 |
| 2007/0266611 | A1 | 11/2007 | Stover | |

(Continued)

*Primary Examiner* — Michael David

(74) *Attorney, Agent, or Firm* — McNees Wallace & Nurick LLC

(57) ABSTRACT

A U-shaped mounting bracket is affixed around a rear iron sight housing. The mounting bracket includes a first and second bracket side that perpendicularly extend from the top bracket side. The first and second bracket sides are secured to the rear iron sight housing of a firearm by a hinge pin driven into the hinge pin holes in the mounting bracket and the rear iron sight housing. Bracket sides extend the top bracket side above the rear sight iron. Fasteners brace the bracket sides securely against the external surface of the rear iron sight housing. The top bracket side can receive a scope rail or the forward mount may have an integrated rail unit. The top bracket side has leveling set to align the attached scope or other sighting device with the axis on the bore of the firearm.

16 Claims, 6 Drawing Sheets

U.S. PATENT DOCUMENTS

2007/0271834 A1* 11/2007 Keng ..... 42/124
2008/0072471 A1 3/2008 Keng
2009/0077855 A1 3/2009 Pritchett
2009/0113778 A1* 5/2009 Paterson ..... 42/90
2010/0175295 A1* 7/2010 Hoel et al. ..... 42/90
2010/0275498 A1* 11/2010 Paterson ..... 42/130

* cited by examiner

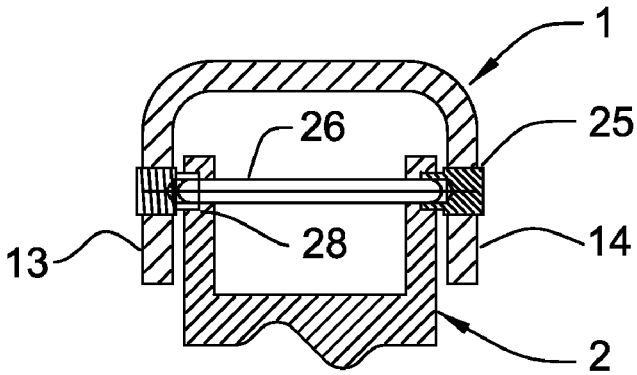
Fig. 10
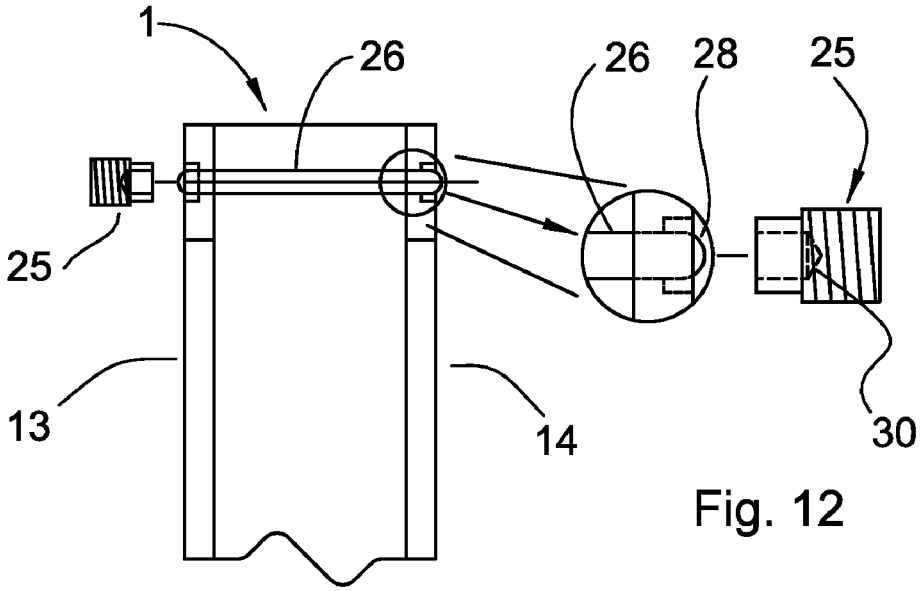
Fig. 12
Fig. 11
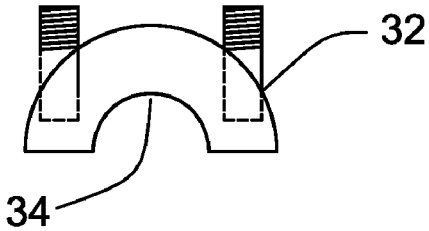
Fig. 13

FORWARD SCOUT SCOPE MOUNT FOR FIREARM

CROSS REFERENCE TO RELATED APPLICATIONS

This patent application claims the benefit of U.S. Provisional Patent Application No. 61/215,357 filed May 4, 2009, entitled SCOUT SCOPE MOUNT FOR BOLT ACTION RIFLE, for which priority is claimed and the disclosure of which is hereby incorporated by reference.

FIELD OF THE INVENTION

The present invention is directed to a mount apparatus for a firearm and specifically to a forward mounting apparatus for a rifle.

BACKGROUND OF THE INVENTION

The present invention is directed toward a mounting apparatus to be used generally in conjunction with a firearm and in particular, a bolt-action rifle such as a Mosin-Nagant rifle and similar firearms, to affix a scope assembly or other sighting device in a position forward of the rifle receiver in a manner which does not significantly impede the adjustment or use of the rifle's iron sights.

The Mosin-Nagant rifle is a military rifle that was used by the armed forces of the Russian Empire, the Soviet Union and various Eastern bloc nations from 1891 until the 1960's. The rifle was particularly prevalent in World War II when the Mosin-Nagant was the standard issue weapon to the Soviet troops. The rifle is still used in military conflicts due to its ruggedness and widespread availability.

In recent years, the Mosin-Nagant has become a popular hunting rifle, particularly in the United States. The rifle is relatively inexpensive, very sturdy, reliable and military accurate. Readily available models include the Russian Mosin-Nagant M91/30; M91/59; M38; M44 and the Finnish M39.

The Mosin-Nagant rifle is not equipped with a built-in telescopic sight. Instead, the Mosin-Nagant rifle has a pair of simple, unmagnified iron sights, which are referred to as the front and rear sights, to assist in the aiming of the rifle. If to attach another sighting device to the rifle, such as a telescopic or optical sight, often referred to as a scope, the user must employ one of various types of scope mounts known in the art. These prior art scope mounts typically fall into two types, a rearward scope mount which is mounted on the receiver portion of the rifle, or a forward scope mount, sometimes referred to as a scout mount, which is mounted on the rifle forward of the receiver.

Unfortunately, the design of the Mosin-Nagant rifle is not well suited to conventional rearward scope mounts because the rifle bolt action swings upward when the breech is opened, thus interfering with the placement of a scope mount on the receiver. Other styles of rifles which eject spent cartridges straight up also would not be well suited for a rearward scope mount. Thus, a forward scope mount is generally favored for these styles of rifles. However, forward scope mounts disclosed in prior art for use with Mosin-Nagant style rifles require removal of the original iron site to affix the scope mount. This arrangement has several disadvantages as it requires modification of the rifle and additionally renders the iron sites unusable while the scope mount is attached. Additionally, there is a possibility that the original rear iron site might become damaged and/or misplaced after removal which makes replacement problematic given that these rifles have been out of production for many years. In view of the disadvantages of the devices known in the art, there is a need for a relatively simple and easily operable forward scope mount that can be removably affixed to the rifle without the need to make alterations to the firearm and without rendering the iron sights inoperable.

SUMMARY OF THE INVENTION

A forward mounting device is comprised of a U-shaped mounting bracket removably affixed around the rear iron sight housing. The mounting bracket is comprised of a first and second bracket side that perpendicularly extend from the top bracket side and are generally parallel to each other. The first and second bracket sides are secured to the rear iron sight housing of a firearm by an elongated replacement hinge pin driven into the hinge pin holes in the mounting bracket and the rear iron sight housing and the bracket sides are of a sufficient length to extend the top bracket side above the top of the rear sight iron on the firearm. The bracket sides have fasteners to brace the bracket sides securely against the external surface of the rear iron sight housing of the firearm. The top bracket side can either accommodate a commercially available scope rail such as a Weaver Rail, or in alternative embodiments, a suitable scope rail is already affixed to the mounting bracket or the forward mount is made as a mounting bracket with an integrated rail unit. The top bracket side has leveling set screws to allow the top bracket side to be tilted up and down so as to align the attached scope or other sighting device with the axis on the bore of the firearm.

A first object of the invention is to provide for a simple, relatively inexpensive and easily manufactured forward mount that can be removably attached to the rear iron sight housing of the firearm without the need to make alterations to the firearm and without rendering the iron sights inoperable.

Another object of the invention is to provide for a forward mount that is simple to attach to the rear iron sight housing of a firearm and that will hold a suitable scope assembly or other sighting device securely in place when the firearm is fired.

Still another object of the invention is to provide for a forward mount to attach to the rear sight iron housing of a firearm that may be easily tilted up or down so as to align the attached scope assembly or other sighting device with the axis of the bore of the firearm.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

FIG. 10 shows an elevational view of an alternate embodiment of a forward mount.

FIG. 11 shows a plan view taken from the underside of the forward mount.

FIG. 12 shows a detail of a connection between a hinge pin and a modified set screw.

FIG. 13 shows an arcuate transfer shoe.

DETAILED DESCRIPTION OF THE INVENTION

With reference to the drawings, wherein like numerals represent like parts throughout the figures, a forward mount in accordance with the present invention is generally designated by numeral 1. Representative forward mounts in accordance with the present invention are illustrated in FIGS. 1-9. Component parts obscured by the front surface of any view in FIGS. 1-9 are depicted in broken lines.

Figure 1:
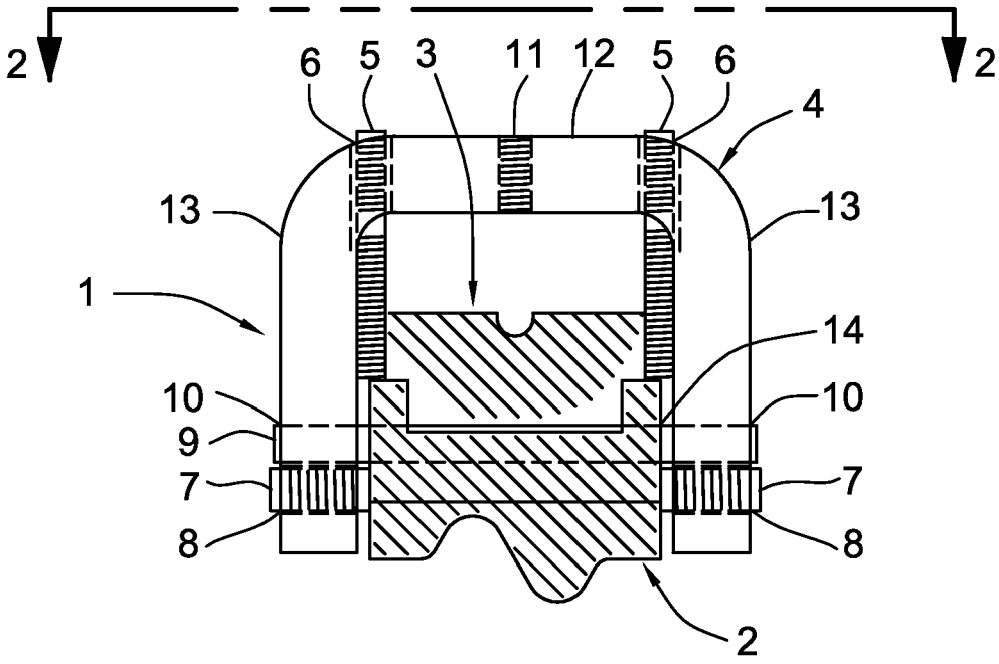
FIG. 1 is a front elevation view of a preferred embodiment of the forward mount without an integrated rail, attached to the rear iron sight housing of a rifle.
Figure 2:
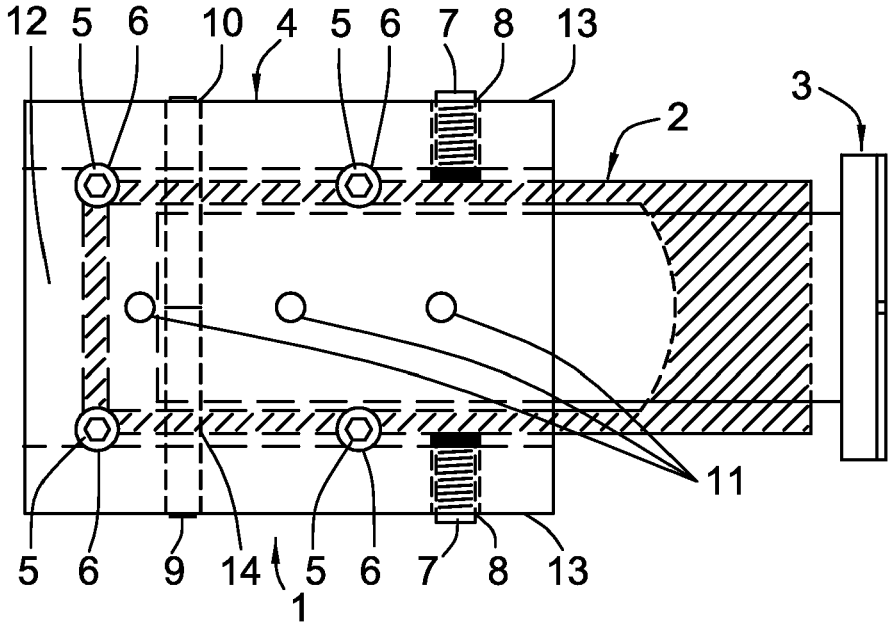
FIG. 2 is a top plan view of a preferred embodiment of the forward mount without an integrated rail, attached to the rear iron sight housing of a rifle.
Figure 3:
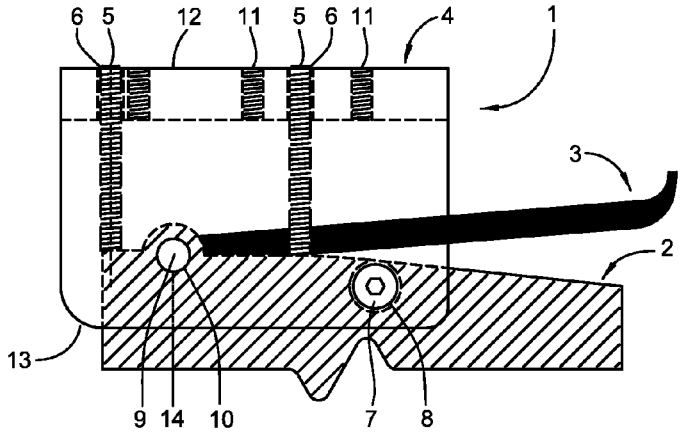
FIG. 3 is a side-elevation view of a preferred embodiment of the forward mount without an integrated rail, attached to the rear iron sight housing of a rifle.

A first embodiment of forward mount 1 in accordance with the present invention is illustrated in FIGS. 1-3. Forward mount 1 is shown attached to the rear iron sight housing 2 of a rifle 2. In FIG. 1, a breakaway portion of the rear iron sight is generally designated by numeral 3.

Forward mount 1 is comprised of a three-sided U-shaped mounting bracket 4, a plurality of leveling set screws 5, a plurality of threaded leveling set screw holes 6, a plurality of securing set screws 7, a plurality of threaded securing set screw holes 8, an elongated replacement hinge pin 9, a first and second bracket hinge pin hole 10 and a plurality of threaded rail attachment holes 11. The mounting bracket 4 is comprised of a top bracket side 12 and a first bracket side 13 and second bracket side 14 that perpendicularly extend from the top bracket side 12 and are generally parallel to each other. First bracket side 13 and second bracket side 14 are secured to rear iron sight housing 2 by replacement hinge pin 9 driven into housing hinge pin holes 15 and through corresponding bracket hinge pin holes 10 in first bracket side 13 and second bracket side 14. First bracket side 13 and second bracket side 14 are of sufficient length to extend top bracket side 12 above the rear iron sight 3 on the firearm, so that iron sight 3 may be aligned with a post at the end of the rifle barrel (not shown), unobstructed by forward mount 1. First and second bracket arms 13, 14 are held securely against the external surface of the rear iron sight housing 2 by securing set screws 7 threaded through corresponding securing set screw holes 8 in first and second bracket sides 13, 14.

Top bracket side 12 has rail attachment holes 11 to affix any commercially available scope mounting rail, e.g., a Weaver- or Picatinny-style mounting rail, to top bracket side 12. Top bracket side 12 has set screw holes 6 drilled and tapped to accommodate leveling set screws 5 threaded therethrough. Turning leveling set screws 5 allows top bracket side 12 to be tilted up and down so as to align an attached scope 17 (FIG. 9) with the axis on the bore of the firearm, e.g., to zero the scope on a target at a predetermined distance. This provides initial elevation setting. The scope 17 internal adjustment takes care of fine adjustment.

Forward mount 1 is attached to rear iron sight housing 2 by attaching suitable scope rings 22 (FIG. 9) around the selected scope 17 (See, e.g., FIG. 9) and attaching the scope rings 22 on a suitable scope rail 18. The scope rail 18 to which the scope 17 and scope rings 22 have been attached is first attached to the top bracket side 12 with mounting screws (not shown) through the threaded rail attachment holes 11. Next, the original rear iron sight housing hinge pin (not shown) is slightly dislodged from housing hinge pin holes 15 by tapping the original hinge pin out of housing hinge pin holes 15 with a pin punch or replacement hinge pin 9 by application of a tapping force. The forward mount 1 is then inserted over the rear iron sight housing 2 and the bracket hinge pin holes 10 are aligned with housing hinge pin holes 15. Replacement hinge pin 9 may have one or both ends tapered for insertion into the opening of the housing hinge pin holes 15 where the original hinge pin has been depressed by tapping force. The replacement hinge pin 9 is then tapped into the housing hinge pin holes 15 forcing the original pin out of the housing hinge pin holes 15. When tapped into place, the replacement hinge pin 9 will hold the rear iron sight 3 and the mounting bracket 4 in place on the rear iron sight housing 2. Once the replacement hinge pin 9 is installed, the leveling set screws 5 are inserted in to the leveling set screw holes 6 and the top bracket side 12 is then leveled to align the attached scope with the axis on the bore of the firearm. The top surface of rear iron sight housing 2 forward of housing hinge pin hole 15 may need to be filed down slightly to provide a flat surface to accommodate the bottom end of leveling set screw 5. Next, the securing set screws 7 are inserted into the securing set screw holes 8 and tightened to secure the first bracket side 13 and second bracket side 14 against the exterior surfaces of the rear iron sight housing 2.

In some cases, the housing hinge pin holes 15 of the firearm are slightly out of line which after attachment of the mount and scope assembly to the firearm may prevent proper adjustment of the scope from side to side. In such cases, an adjustable scope ring such as a Millet ring should be used to correct for windage.

Attachment of forward mount 1 to the firearm does not significantly impede the adjustment or use of the firearm's iron sights as the sight irons will remain adjustable to accommodate shooting distances in excess of ordinary hunting ranges.

Figure 4:
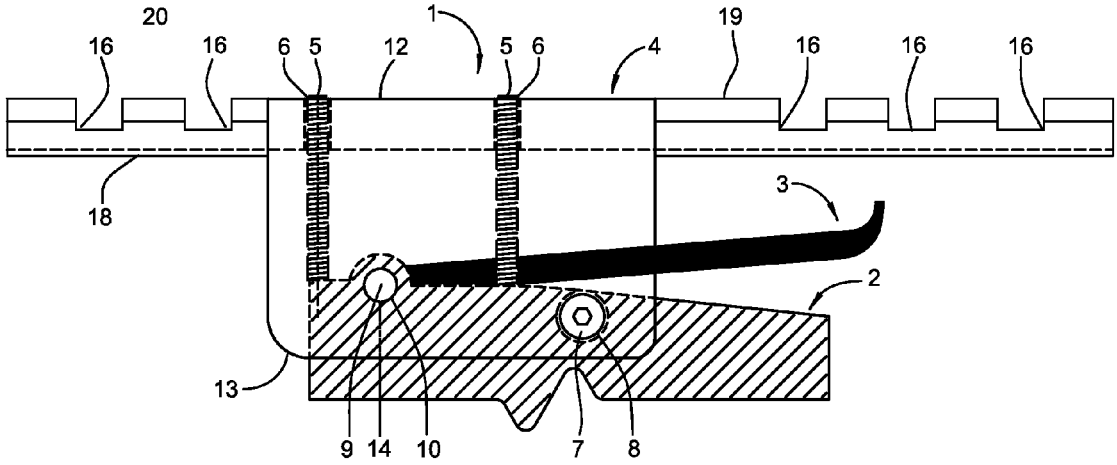
FIG. 4 is a side-elevation view of a preferred embodiment of the forward mount with an integrated rail, secured by suitable means and attached to the rear iron sight housing of a rifle.
Figure 5:
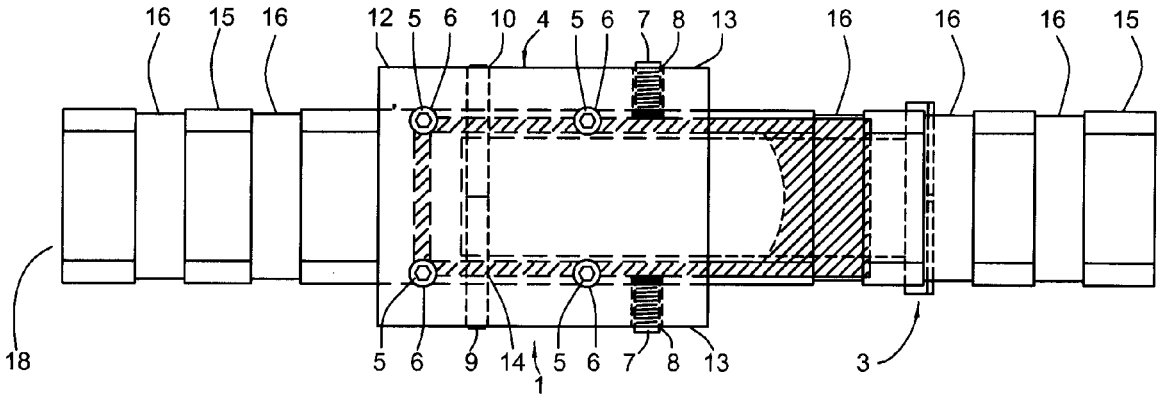
FIG. 5 is a top plan view of a preferred embodiment of the forward mount with an integrated rail, secured by suitable means and attached to the rear iron sight housing of a rifle.
Figure 6:
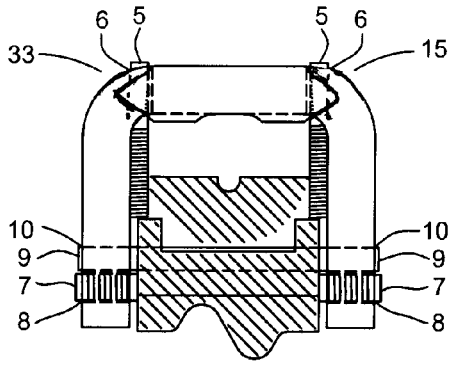
FIG. 6 is a front elevation view of a preferred embodiment of the forward mount with an integrated rail, secured by suitable means and attached to the rear iron sight housing of a rifle.

Another embodiment of the invention with an integrated rail affixed by a suitable means is depicted in FIGS. 4-6. The front rail portion 19 and rear rail portion 20 are affixed to the front and rear ends, respectively, of top bracket side 12 by suitable means, for example, by silver soldering or brazing or welding.

Figure 7:
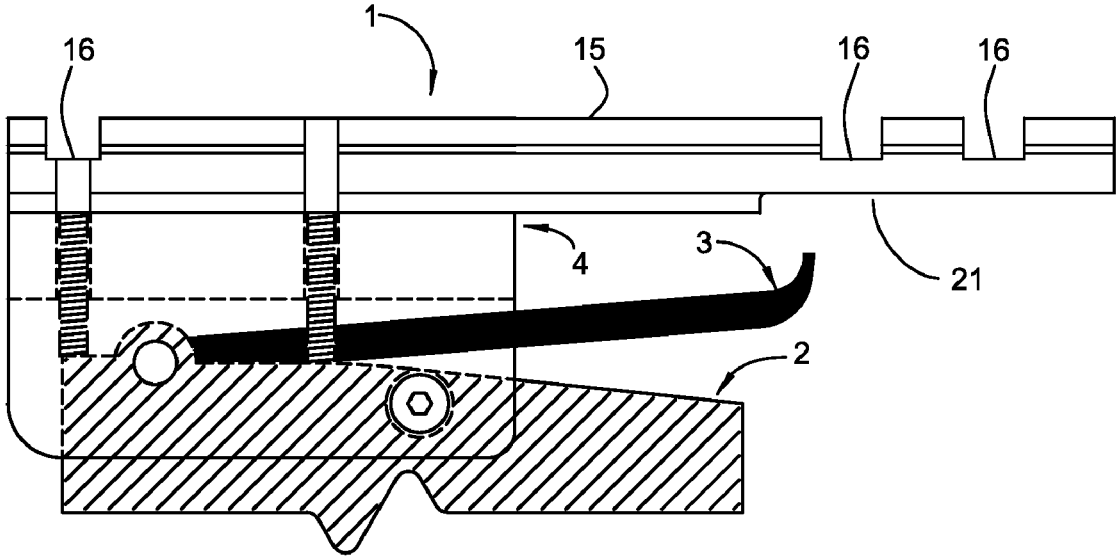
FIG. 7 is a side-elevation view of a preferred embodiment of the forward mount with an integrated rail and mount machined from one piece of suitable metal or from extruded metal, attached to the rear iron sight housing of a rifle.
Figure 8:
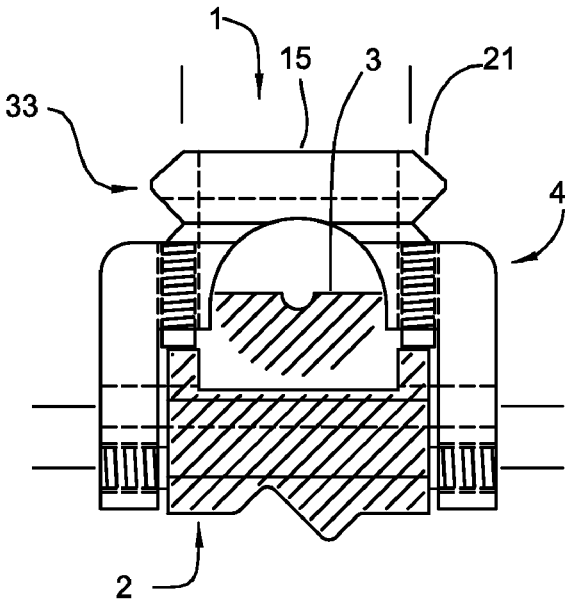
FIG. 8 is a front elevation view of a preferred embodiment of the forward mount with an integrated rail and mount machined from one piece suitable metal or from extruded metal, attached to the rear iron sight housing of a rifle.

In yet another embodiment depicted in FIGS. 7-8, mounting bracket 4 and an integrated mounting rail 21 may be fabricated as a single piece by suitable means such as machining the unit from suitable metal. Alternatively, the mounting bracket 4 and integrated mounting rail 21 can be manufactured from extruded metal or die cast in a single piece. Integral mounting rail 21 includes a generally planar top surface 15, with rail grooves 16 spaced at predetermined intervals along the top surface, the grooves configured for receiving mounting fasteners of a scope ring. Sides 33 of rail 21 may have a pointed profile to engage standardized form scope rings. This embodiment provides the advantage of a continuous full length rail instead of a front and rear stub rail shown in FIG. 4. Rail 21 may include more or less grooves 16 as required.

Figure 9:
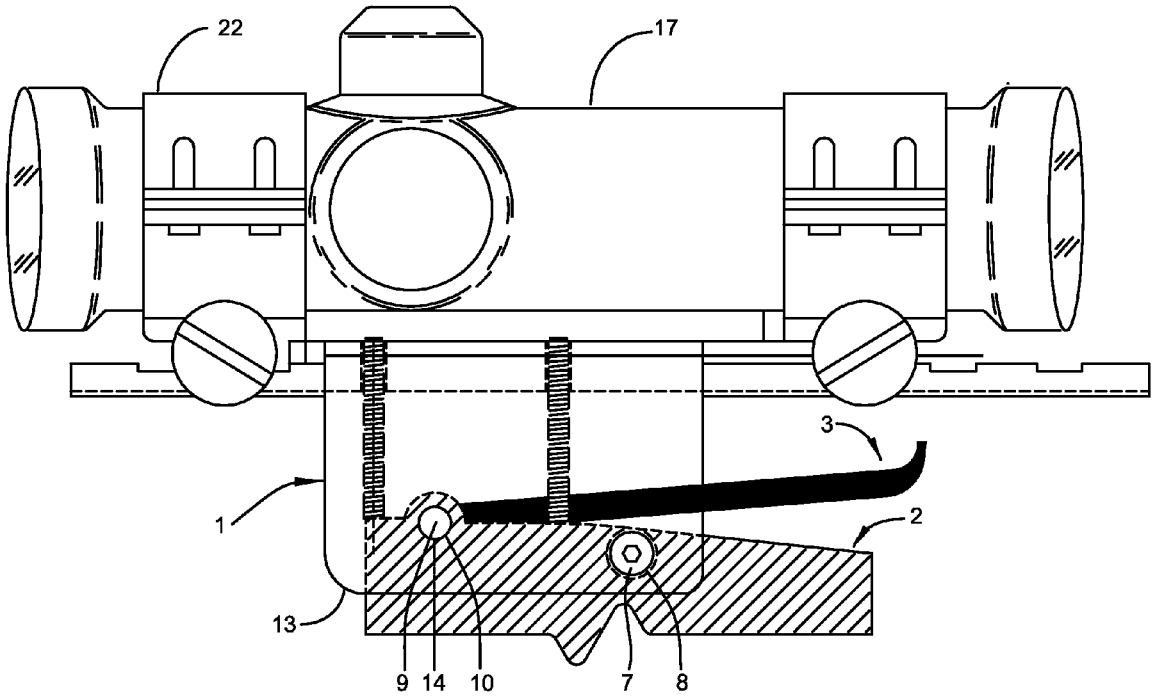
FIG. 9 is a side-elevation view of a preferred embodiment of the forward mount with an attached rail and scope assembly a top bracket side attached to a rifle.

In preferred embodiments having integrated rails, the front and rear rail portions 19 and 20 or integrated mounting rail 21 are manufactured to have rail grooves 16 and an overall length which generally conforms to standard commercially available scope rails. These integrated rails also have leveling set screw holes 6 and scope ring mounting grooves 16 which may be placed on the flat surface of the front and rear rail portions 19 and 20 or integrated mounting rail 21 or alternatively, in the rail grooves 16. In either case, attachment of the scope assembly and an embodiment of this invention with an integrated rail to the rear iron sight housing 2 follows the same steps as attachment of a preferred embodiment that does not have an integrated rail except that a suitable commercial scope rail does not need to be attached to the mount. FIG. 9 illustrates a scope 17 mounted on a mounting bracket with integrated front and rear rail portions as shown in FIGS. 4-6. It is understood that the scope 17 may be mounted on a separately attachable rail to bracket 4 (FIGS. 1-3), or an integral, single-piece mounting rail as shown in FIGS. 7-8.

Referring next to FIGS. 10 and 11, in at least one alternate embodiment a forward mount 1 may be attached to an iron sight housing 2 by attaching the forward mount 1 with a modified set screw 25 to an original or existing hinge pin 26. E.g., a Mauser K98 controlled-feed bolt-action rifle has an iron sight housing 2 mounted above the rifle barrel just forward of the receiver (not shown). Mount bracket 4 rotates about original iron sight housing 2 or hinge pin 26 for initial elevation adjustment similar to that which is described above with respect to FIGS. 1-9. In iron sight housing 2, pin-receiving holes 28 are counterbored into both sides of iron sight housing 2 from the outside. In one exemplary embodiment pin-receiving holes 28 may have a diameter of approximately 4 millimeters (mm). Modified set screws 25 thread through each of bracket sidewalls 13, 14. Forward mount 1 fits over iron sight housing 2. Each of modified set screws 25 is threaded through first and second bracket sides 13 and 14, respectively, and into counterbore holes 28 until modified set screws 25 bottom in counterbore holes 28. Preferably, modified set screws 25 are threaded approximately the same number of turns through the respective bracket sides 13, 14, such that iron sight housing 2 is approximately centered between bracket sides 13, 14. Modified set screw 25 has a recess 30 bored in one end to receive an end of hinge pin 28 without interference.

In addition, a transfer shoe 32 with an arcuate side 34 is positioned atop the circular barrel to distribute the force of two set screws to a protective sheet metal edging that is disposed at the end of a wood stock (not shown).

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A mount for attaching a scope assembly or other sighting device to a rear iron sight housing of a firearm, the mount comprising:

a mounting bracket comprising a top bracket side and opposing first and second bracket sides, the mounting bracket configured to be removably attached to the rear iron sight housing by a hinge pin;

the hinge pin extending through the rear iron sight housing, the first bracket side and the second bracket side to secure the mounting bracket to the rear iron sight housing, the mounting bracket rotatable about the hinge pin for adjusting a level of the mounting bracket relative to the firearm; and the top bracket side is disposed above the rear iron sight housing when the mounting bracket is attached to the rear iron sight to permit unobstructed view of a target through the iron sight housing.

2. The mount of claim 1 wherein the first bracket side, the second bracket side and the top bracket side define an open end between the first and second bracket sides and opposite the top bracket side, such that each of the first bracket side and second bracket side fit around an exterior side surfaces of the rear iron sight housing.

3. The mount of claim 2 wherein each of the first bracket side and the second bracket side includes a bracket hinge pin hole for receiving a replacement hinge pin, the replacement hinge pin extending through the bracket hinge pin hole in the first bracket side, through a housing hinge pin hole on an adjacent side of the rear iron sight housing and then into and through an opposing housing hinge pin hole and the bracket hinge pin hole in the second bracket side.

4. The mount of claim 3 further comprising at least one rail attachment hole disposed through the outer surface of the top bracket side between the first bracket side and second bracket side, the at least one rail attachment hole being adapted for receiving a fastener for attachment of a scope rail to the top bracket side.

5. The mount of claim 3 further comprising a set screw and a set screw hole bored through each of the first bracket side and second bracket side, to receive the set screw, the set screw adjustable when threaded through one of the first or second bracket side to maintain the first bracket side and second bracket side securely against the rear iron sight housing.

6. The mount of claim 3 further comprising a leveling screw and a leveling set screw hole bored through the top bracket side to receive the leveling set screw, the leveling set screw adjustable when threaded through the top bracket side to adjust an angle of the top bracket side.

7. The mount of claim 3 wherein the top bracket side has a first mounting rail fixed to a front end of the top bracket side and a second mounting rail fixed to a rear end of the top bracket side, the top bracket side, the first mounting rail and the second mounting rail creating a substantially elongated planar mounting structure for receiving a scope ring.

8. The mount of claim 7 wherein the mounting surface has a scope ring mounting groove disposed across the top mounting surface configured to receive fasteners of a scope ring.

9. The mount of claim 7 further including a set screw and a set screw bore hole in the first bracket side and second bracket sides to receive the set screw, the set screw adjustable to fix the first bracket side and second bracket side relative to the rear iron sight housing.

10. The mount of claim 7 further including a leveling screw and a leveling set screw bore hole disposed through the mounting surface, the leveling set screw enabling the mounting surface to be adjusted with respect to the planar angle of the mounting surface.

11. The mount of claim 7 wherein the mounting surface further comprises a plurality of raised ridges interspersed with a plurality of flat spacing slots, the mounting surface being adapted for attaching a scope ring within the flat spacing slots.

12. The mount of claim 2 wherein the top bracket side further comprises a front rail portion and a rear rail portion, attached to a front end and a rear end of top bracket side extending perpendicularly in opposite directions of the first bracket side and second bracket side and defining a bracket mounting structure, the bracket mounting structure including a bracket mounting surface, the bracket mounting structure being adapted for mounting of a Weaver style scope ring.

13. The mount of claim 12 wherein the bracket mounting surface has a scope ring mounting groove extending across a distal end of the first bracket side and second bracket side, the scope ring mounting groove being adapted for attaching a scope ring with fasteners.

14. The mount of claim 12 further including a set screw and a set screw bore hole in the first bracket side and second bracket sides to receive the set screw, the set screw adjustable to tension the first bracket side and second bracket side securely against the external surface of the rear iron sight housing.

15. The mount of claim 12 further including a leveling screw and a leveling set screw bore hole disposed through the bracket mounting surface, the leveling set screw enabling the bracket mounting surface to be adjusted with respect to the planar angle of the bracket mounting surface.

16. The mount of claim 12 wherein the bracket mounting surface has a plurality of raised ridges with a T-shaped cross-section interspersed with a plurality of flat spacing grooves, the mounting surface configured to receive a scope ring within the flat spacing grooves.

* * * * *